US008544426B2

(12) United States Patent
Watanabe et al.

(10) Patent No.: US 8,544,426 B2
(45) Date of Patent: Oct. 1, 2013

(54) COOLANT PASSAGE APPARATUS FOR INTERNAL COMBUSTION ENGINE

(75) Inventors: Tetsuji Watanabe, Toyota (JP); Fujio Inoue, Kiyose (JP)

(73) Assignees: Nippon Thermostat Co., Ltd., Tokyo (JP); Toyota Jidosha Kabushiki Kaisha, Toyota-shi (JP)

( * ) Notice: Subject to any disclaimer, the term of this patent is extended or adjusted under 35 U.S.C. 154(b) by 210 days.

(21) Appl. No.: 13/094,293

(22) Filed: Apr. 26, 2011

(65) Prior Publication Data

US 2011/0265739 A1 Nov. 3, 2011

(30) Foreign Application Priority Data

Apr. 28, 2010 (JP) ..... 2010-103998

(51) Int. Cl.
*F01P 9/00* (2006.01)

(52) U.S. Cl.
USPC ..... 123/41.01; 123/41.16; 164/442; 164/448

(58) Field of Classification Search
USPC ..... 123/41.01, 41.16, 41.14, 41.44, 41.7, 123/41.79; 164/442, 448
See application file for complete search history.

(56) References Cited

U.S. PATENT DOCUMENTS

| | | | | |
|---|---|---|---|---|
| 4,745,885 | A * | 5/1988 | Koinuma | 123/41.05 |
| 5,103,774 | A * | 4/1992 | Hirata et al. | 123/41.1 |
| 6,755,217 | B1 * | 6/2004 | Yoshida et al. | 138/121 |
| 7,478,612 | B2 * | 1/2009 | Shiozaki et al. | 123/41.1 |
| 2006/0012034 | A1 * | 1/2006 | Kadoya et al. | 257/712 |
| 2006/0032258 | A1 * | 2/2006 | Pruitt et al. | 62/310 |
| 2009/0151658 | A1 * | 6/2009 | Lee | 123/41.09 |
| 2009/0255489 | A1 * | 10/2009 | Fujiwara et al. | 123/41.57 |
| 2009/0255748 | A1 * | 10/2009 | Fujiwara | 180/229 |

FOREIGN PATENT DOCUMENTS

| | | | |
|---|---|---|---|
| JP | 4-16610 | B2 | 3/1992 |
| JP | 05-039719 | A | 2/1993 |
| JP | 2008-215173 | A | 9/2008 |
| JP | 2009-255627 | A | 11/2009 |
| JP | 2010-196571 | A | 9/2010 |

OTHER PUBLICATIONS

Japanese Office Action dated Feb. 20, 2012, issued in corresponding Japanese Patent Application No. 2010-103998.

* cited by examiner

*Primary Examiner* — Noah Kamen
*Assistant Examiner* — Long T Tran
(74) *Attorney, Agent, or Firm* — Westerman, Hattori, Daniels & Adrian, LLP

(57) ABSTRACT

A coolant passage apparatus 10 is formed by joining a plurality of resin moldings 31 and 32 which are each individually molded. A pair of coolant receiving pipes 11 and 12 for respectively receiving a coolant from a pair of engine heads and riser pipes 17 and 18 adjoining the coolant receiving pipes are provided, a central passage 19 is formed between the riser pipes, and a communicating tube 21 which is towards a radiator is formed to communicate with the central passage. Assuming that a line passing through the center of the central passage 19 is (indicated by) A and lines passing through the centers of the above-mentioned riser pipes are (indicated by) B respectively, each of the lines B is outwardly and obtusely angled with respect to the line A, and the riser pipes are respectively molded on both sides of the central passage to incline outwardly.

6 Claims, 10 Drawing Sheets

COOLANT PASSAGE APPARATUS FOR INTERNAL COMBUSTION ENGINE

BACKGROUND OF THE INVENTION

1. Field of the Invention

The present invention relates to a coolant passage apparatus used suitably for a cooling device which cools an internal combustion engine (hereinafter also referred to as engine) by circulating a coolant between a fluid passage formed in the internal combustion engine and a radiator.

2. Description of the Related Art

In this type of engine cooling device, it is arranged that not only an engine is cooled by circulating a coolant between a fluid passage formed in the internal combustion engine and a radiator but also the coolant is supplied to a heater circulation channel provided with a heater core for heating. Furthermore, in these days it is proposed that the coolant from the engine is also used for an ATF (Automatic Transmission Fluid) warmer or an EGR (Exhaust Gas Recirculation) cooler.

Therefore, as described above, in order that the coolant is circulated in or supplied to each part, it becomes necessary to use a branch pipe separately and connect it to piping. Thus, there arises a problem that the piping in an engine room becomes complicated and worsens engine maintenance.

Then, in order to simplify connection of the pipes described above, a coolant passage apparatus is disclosed in prior art shown below in which the piping is directly attached to a coolant discharging outlet of the engine, a thermo valve is accommodated in the piping, and connection parts of the pipes are collected.

Incidentally, the coolant passage apparatus disclosed in Japanese Patent Publication No. H4-16610 has a complicated structure including, for example, a collecting pipe for receiving and collecting a coolant by directly connecting a pair of respective banks of a V-engine, a by-pass passage, an outlet for supplying the coolant to a radiator, an inlet for receiving the coolant from the radiator, a piping connection part for a water pump, etc.

In such a coolant passage apparatus, the whole apparatus is molded from a metal material, so that the molding process is not so easy. Thus, there arises a problem in that the molding process adds costs and increases its weight.

Then, the applicants have filed a patent application, Japanese Patent Application No. 2009-41771 entitled "Coolant Passage Apparatus" in which the whole coolant passage apparatus is molded from a synthetic resin so as to reduce its weight and costs taking advantage of the ease of resin mold.

According to our earlier application filed by the applicants entitled "Coolant Passage Apparatus", it is possible to obtain sufficient machining accuracy with respect to a required portion, the whole apparatus can absorb and disperse stress applied to the apparatus, and it becomes possible to effectively cope with the stress caused by thermal expansion of the engine and an offset of a joint caused by a difference in thermal expansion coefficient between the engine and the above-mentioned equipment.

FIGS. 9 and 10 show an example of the coolant passage apparatus of the patent application filed by the applicants previously. In addition, FIG. 9 is a perspective view showing the apparatus viewed from the rear, which is separated into first and second bodies (situation before both are joined together) and FIG. 10 is a front view showing the coolant passage apparatus viewed from the front whose bodies are joined together.

In the coolant passage apparatus 10, shown in FIGS. 9 and 10, of the earlier application, a pair of coolant receiving pipes 11 and 12 which respectively receive the coolant discharged from the right and left engine heads in the V-engine are provided on the first body 31 side, and a central passage 19 which collects the coolant, a communicating tube 21 which is towards the radiator through the above-mentioned central passage 19, etc. are provided on the second body 32 side. The first body 31 and second body 32 molded from a resin are joined together by a welding means, for example, to form the coolant passage apparatus 10.

Incidentally, in the coolant passage apparatus 10 proposed previously, the pair of coolant receiving pipes 11 and 12 are arranged to communicate with the riser pipes 17 and 18 which rise perpendicularly and communicate with the above-mentioned central passage 19 which is formed horizontally through these riser pipes 17 and 18.

In other words, assuming that a line passing through the center of the above-mentioned central passage 19 in the passage apparatus 10 is (indicated by) A which is horizontal, lines B passing through the centers of the above-mentioned riser pipes 17 and 18 rise at right angles to the above-mentioned line A to be perpendicular. Further, lines C passing through the centers of the pair of coolant receiving pipes 11 and 12 are arranged at right angles to the above-mentioned lines B to be horizontal.

Therefore, according to the coolant passage apparatus 10 having the above-described structure, the coolant flows out towards the communicating tube 21 which is towards the radiator, being turned at substantially right angles in order of lines C→B→A. Thus, the coolant which passes through (the inside of) the apparatus 10 is a complicated flow along a plurality of right-angled bends. For this reason, resistance takes place in the flow of the coolant, which affects a flow rate of the coolant, thus there arises a problem of affecting the cooling capacity of the whole engine.

Further, in the coolant passage apparatus 10 proposed previously, since a channel from the pair of coolant receiving pipes 11 and 12 to the communicating tube 21 which is towards the radiator is arranged to be bent substantially at right angles continuously as described above, the whole apparatus 10 becomes larger naturally. For this reason, it is often the case that stress is generated by the difference in thermal expansion coefficient between the engine and the above-mentioned apparatus 10, and another device for absorbing this is also needed.

Furthermore, in the coolant passage apparatus 10 having the above-described structure, the total length around the junction portion for joining the first body 31 to the second body 32 which are molded from a resin becomes long, so that particular device is also required in order to secure the reliability against the leakage at the junction portion, and there is room for further improvement.

SUMMARY OF THE INVENTION

The present invention aims at improving the coolant passage apparatus proposed previously in order to solve the problems as described above, and providing a coolant passage apparatus in which the flow of the coolant in the apparatus is smoothed and the whole apparatus is reduced in thickness (reduced in size), so that the reliability of the junction portion can be sufficiently secured by shortening the length of the junction portion for joining the above-mentioned first body to the second body.

The coolant passage apparatus for the internal combustion engine in accordance with the present invention made in order to solve the above-mentioned problems is a coolant passage apparatus used for a cooling device of an internal combustion engine in which a circulation channel for a coolant is formed between a fluid passage formed in the internal combustion engine and a radiator, and provided between a coolant outlet of the above-mentioned internal combustion engine and a coolant inlet of the above-mentioned radiator, wherein the above-mentioned coolant passage apparatus is formed by joining a plurality of resin moldings which are each individually molded, a pair of coolant receiving pipes for respectively receiving the coolant from a pair of engine heads in the above-mentioned internal combustion engine and riser pipes adjoining the above-mentioned coolant receiving pipes are provided, a central passage is formed between the above-mentioned riser pipes, and a communicating tube which is towards the radiator is formed so as to communicate with the above-mentioned central passage, and wherein assuming that a line passing through the center of the above-mentioned central passage is (indicated by) A and lines passing through the centers of the above-mentioned riser pipes are (indicated by) B respectively, each of the above-mentioned lines B is outwardly and obtusely angled with respect to the above-mentioned line A, and the above-mentioned riser pipes are respectively molded on both sides of the above-mentioned central passage to incline outwardly.

In this case, it is preferable that the above-mentioned one pair of coolant receiving pipes and the communicating tube which is towards the radiator are integrally molded in one resin molding of a plurality of the above-mentioned resin moldings.

In addition, it is desirable that the above-mentioned resin molding is constituted by two resin moldings of a first body and a second body, and a junction face between the above-mentioned first body and second body is formed so as to be parallel with a surface along the above-mentioned line A.

Further, in a preferred embodiment, molding is carried out such that in an arrangement where the communicating tube which is towards the above-mentioned radiator is formed in the longitudinal center of the above-mentioned central passage provided between the above-mentioned riser pipes, when the above-mentioned one pair of coolant receiving pipes are viewed on the right and left respectively and the coolant passage apparatus is viewed in plan, a line C passing through the center of the above-mentioned one coolant receiving pipe is obtusely angled with respect to the above-mentioned line A, a line C passing through the center of the above-mentioned other coolant receiving pipe is acutely angled with respect to the above-mentioned line A, and the lines C passing through the centers of the above-mentioned one and other coolant receiving pipes are in parallel with each other.

Further, it is desirable that flange-like joints are formed respectively around openings of the above-mentioned one pair of coolant receiving pipes and each of the joints has formed therein bolt inserting engage holes.

According to the coolant passage apparatus for the internal combustion engine having the above-described structure, assuming that the line passing through the center of the central passage is (indicated by) A and the lines passing through the centers of the above-mentioned riser pipes are (indicated by) B respectively, each of the above-mentioned lines B is outwardly and obtusely angled with respect to the above-mentioned line A, and the above-mentioned riser pipes are respectively inclined outwardly on both sides of the above-mentioned central passage.

By this structure, a flowing water passage from the pair of coolant receiving pipes to the above-mentioned central passage can reduce a number of the bends so that the coolant in the coolant passage apparatus can flow smoothly. Thus, it is possible to solve the problem that the reduction in flow rate of the coolant affects the cooling capacity of the whole engine.

Further, since each of the above-mentioned lines B is outwardly and obtusely angled with respect to the above-mentioned line A, an amount of flexure which absorbs a difference between thermal expansion of the V-engine and thermal expansion of the coolant passage apparatus mounted to the V-engine can be distributed to the whole apparatus, to thereby avoid applying the stress only to a part of the apparatus. Furthermore, according to the above-mentioned structure, the whole apparatus is reduced in thickness (reduced in size).

In this case, allowing a length equivalent to the length of each riser pipe used for the coolant passage apparatus of the patent application filed previously, the above-mentioned thermal expansion difference can be effectively absorbed with the coolant receiving pipes and the riser pipes.

Further, since a longitudinal dimension of the central passage formed between the riser pipes can be shortened, the length of the junction portion is shortened in the case where the resin moldings are joined together at the above-mentioned central passage part. Thus, it is possible to contribute to improving the reliability against leakage at the above-mentioned junction portion.

DESCRIPTION OF THE PREFERRED EMBODIMENTS

Figure 1:
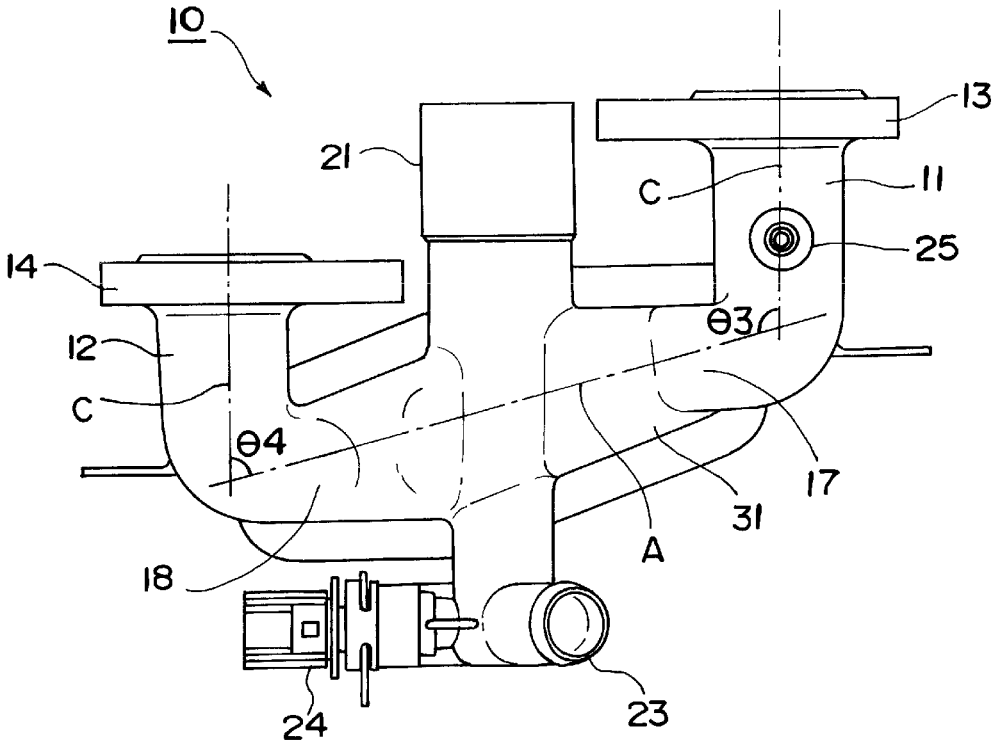
FIG. 1 is a plan view showing a first preferred embodiment of a coolant passage apparatus in accordance with the present invention.
Figure 2:
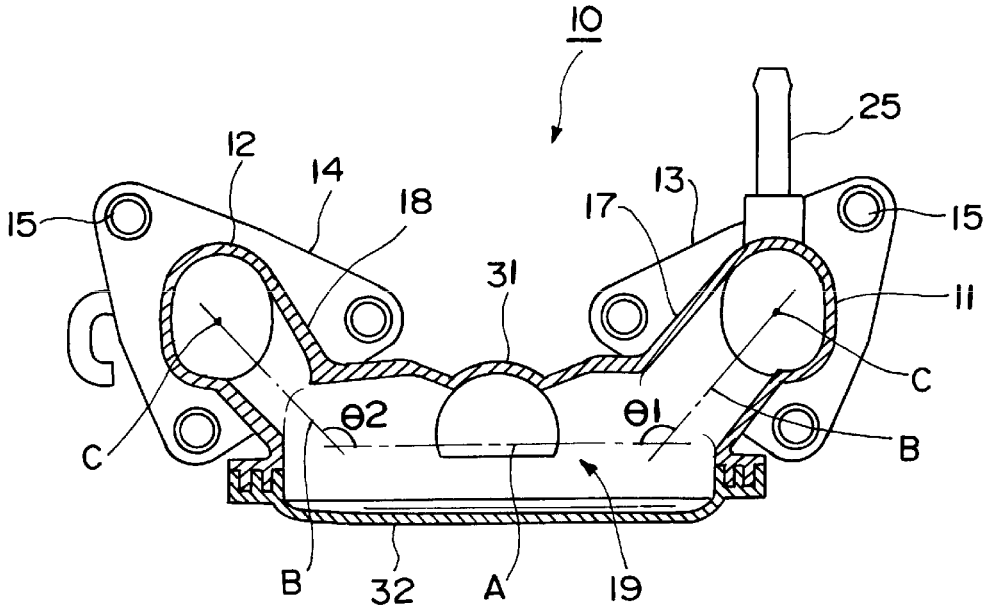
FIG. 2 is a sectional view showing the apparatus shown in FIG. 1 where a first half part is cut away.
Figure 3:
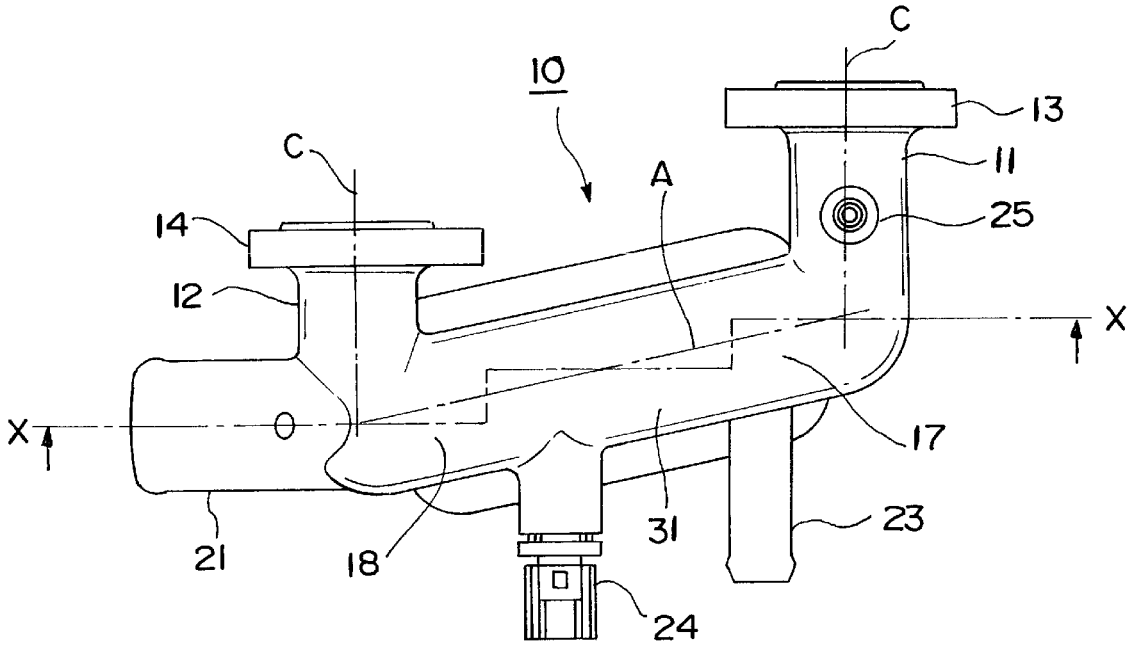
FIG. 3 is a plan view showing a second preferred embodiment of the coolant passage apparatus in accordance with the present invention.

Hereinafter, a coolant passage apparatus in accordance with the present invention will be described with reference to the preferred embodiments shown in the drawings. Firstly, FIGS. 1 and 2 show a first preferred embodiment of the coolant passage apparatus in accordance with the present invention. In addition, this preferred embodiment will be described with reference to an example in which the apparatus is mounted in a V-engine and the coolant from right and left engine heads of the V-engine is collected in the above-mentioned apparatus 10.

As shown in FIGS. 1 and 2, in the coolant passage apparatus 10, a pair of coolant receiving pipes 11 and 12 which respectively receive the coolant from the right and left engine heads in the V-engine are molded in the same sense and flange-like joints (flange) 13 and 14 are formed around openings of the above-mentioned one pair of coolant receiving pipes 11 and 12. Further, bolt inserting holes 15 for joining the apparatus 10 to the right and left engine heads are formed in the above-mentioned joints 13 and 14.

Riser pipes 17 and 18 adjoining the above-mentioned one pair of coolant receiving pipes 11 and 12 are formed integrally therewith respectively, and a central passage 19 for collecting the coolant is formed between the riser pipes 17 and 18 to communicate with the above-mentioned riser pipes 17 and 18. Further, in the first preferred embodiment shown in FIGS. 1 and 2, the communicating tube 21 which is towards the radiator is formed substantially in the longitudinal center of the above-mentioned central passage 19 so as to communicate with the central passage 19. This communicating tube 21 which is towards the radiator is formed in the same sense as that of the above-mentioned one pair of coolant receiving pipes 11 and 12, as shown in FIG. 1.

Furthermore, a communicating tube 23 is formed to be inclined upwards on the opposite side of the communicating tube 21 which is towards the above-mentioned radiator and formed in the above-mentioned central passage 19 of the above-mentioned coolant passage apparatus 10 so as to communicate with the central passage. This communicating tube 23 is used in order to supply the coolant to a heater core part (not shown) used as a heat exchanger for heating a car room.

Still further, a water temperature sensor 24 is arranged in a base end of the communicating tube 23 which is towards the above-mentioned heater core. Yet further, a communicating tube 25 which is towards a throttle body is formed at the above-mentioned one coolant receiving pipe 11 in a perpendicular direction.

Each of the above-mentioned members is integrally formed of one resin molding as the first body 31, and the resin molding as the second body 32 is joined to the first body 31 at the lower bottom of the first body 31 so as to constitute the coolant passage apparatus 10. In other words, in this first preferred embodiment, the second body 32 is arranged at the lower bottom of the first body 31 to function as a so-called cover member which is formed flat to close the above-mentioned central passage 19.

By employing the above-mentioned structure, it is also possible to improve torsional strength of the coolant passage apparatus 10. Further, since the cover member has a comparatively simple structure, it is also possible to facilitate inspection and management of dimensional accuracy.

In addition, the above-mentioned first body 31 and second body 32 are preferably welded in a situation where both the junction portions are overlapped, so that the coolant passage apparatus 10 is formed into one casing. Further, both the junction portions are combined together preferably by way of vibration welding. However, it is also possible to employ welding means by means of laser light. In addition, it is also possible to join them together by means of threaded engagement using a bolt, adhesives, etc.

In the above-mentioned preferred embodiment, assuming that a line which passes through the center of the above-mentioned central passage 19 as shown in FIG. 2 is (indicated by) A and lines passing through the center of each for the above-mentioned riser pipes 17 and 18 are (indicated by) B, respectively, angles (θ1, θ2) subtended by the above-mentioned line A and the above-mentioned lines B respectively extending towards both sides are obtuse and the above-mentioned riser pipes 17 and 18 are molded on both sides of the above-mentioned central passage 19 to incline outwardly, respectively. In addition, it is desirable that the angles of outward inclination of the above-mentioned riser pipes 17 and 18 are in agreement with a bank angle between the pair of heads of the V-engine, but not necessarily limited thereto.

Figure 9:
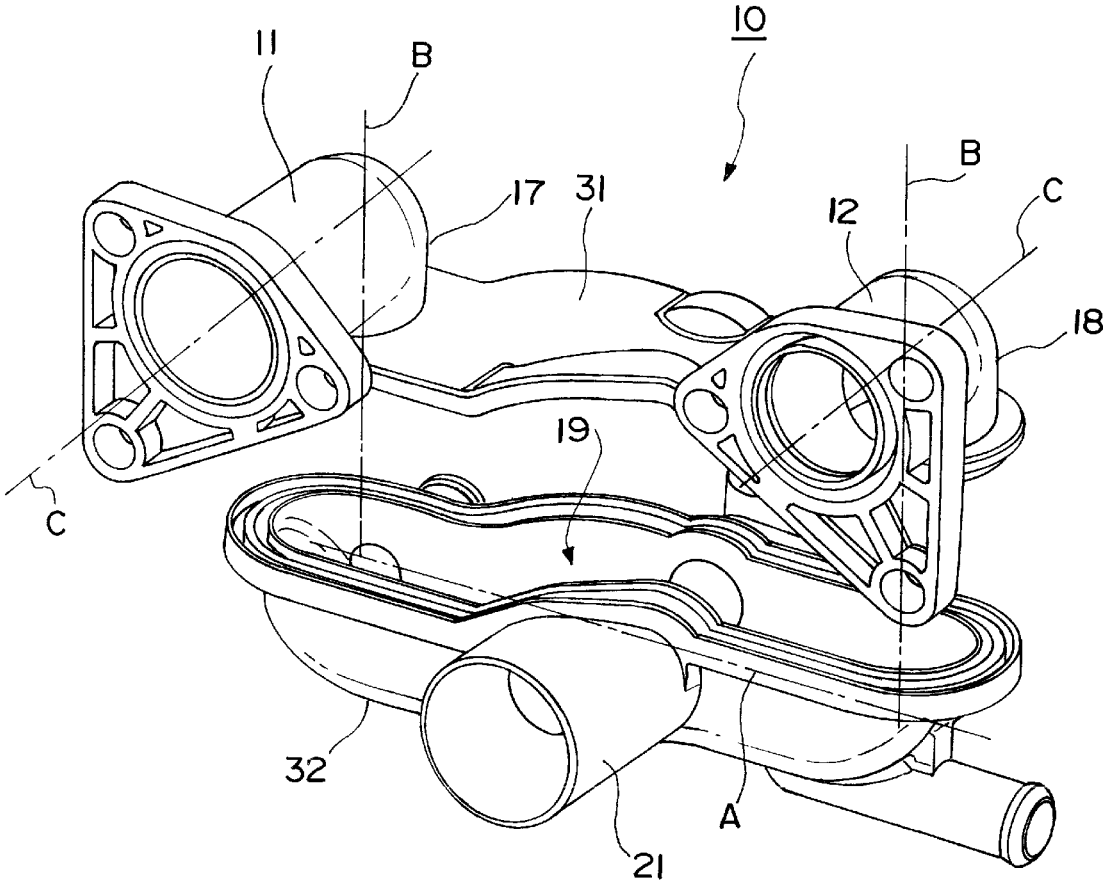
FIG. 9 Prior Art
FIG. 9 is a perspective view showing a prior-art coolant passage apparatus which is separated into first and second bodies.
Figure 10:
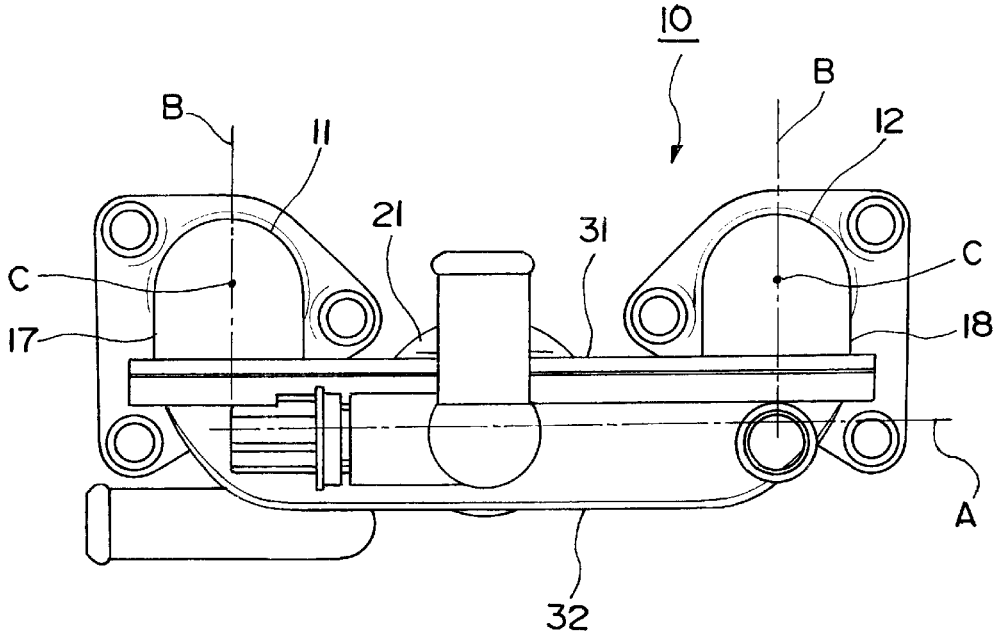
FIG.10 Prior Art
FIG. 10 is a front view of the prior-art coolant passage apparatus.

According to the above-mentioned structure, as described in the column of "Effect of the Invention", it is possible to cause the flow of the coolant in the apparatus to be smooth as compared with that in the apparatus shown in FIGS. 9 and 10 proposed previously. Further, an amount of flexure which absorbs a difference between thermal expansion of the engine and thermal expansion of the coolant passage apparatus can be distributed to the whole apparatus, to thereby increase mechanical strength of the apparatus.

Further, since a longitudinal dimension (dimension in the direction of line A shown in FIG. 2) of the central passage 19 can be shortened, the total length of the junction portions of the first body 31 and the second body 32 can be shortened in the structure where the junction face between the first body 31 and second body 32 is formed so as to be parallel with a plane along the above-mentioned line A as in the preferred embodiment shown in the drawings. It is also possible to improve the reliability against leakage at the above-mentioned junction portion.

In the case where the total length of the above-mentioned junction portions can be shortened, it is possible to employ welding means by means of laser light, for example. According to this, it is possible to shorten welding time, reduce welding flash, and shorten manufacture time.

In addition, the principal part of the apparatus including the above-mentioned pair of coolant receiving pipes 11 and 12 and the communicating tube 21 which is towards the radiator, etc. is molded on the first body 31 side. Thus, since it arranged that the members which must secure dimensional accuracy are collected on one side, it is possible to secure the accuracy of the whole apparatus by managing accuracy on the first body 31 side.

Further, by employing the above-mentioned structure it is possible to reduce man hours, such as confirmation of the accuracy at the time of acceptance inspection for a single component and confirmation of the accuracy after welding, and management points of the accuracy can be facilitated.

Furthermore, in the above-mentioned first preferred embodiment, the molding is carried out such that in a situation as shown in FIG. 1 where one pair of coolant receiving pipes 11 and 12 are viewed on the right and left and the coolant passage apparatus 10 is viewed in plan, an angle (θ3) between the line C passing through the center of one coolant receiving pipe 11 (right-hand side in the drawing) and the line A passing through the center of the above-mentioned central passage 19 is obtusely angled, an angle (θ4) subtended by the line C passing through the center of the other coolant receiving pipe 12 (left-hand side in the drawing) and the above-mentioned line A is acutely angled, and the above-mentioned lines C passing through the centers of the above-mentioned one pair of coolant receiving pipes 11 and 12 are in parallel with each other.

According to this structure, an offset can be generated at a flow path of the coolant which flows into the above-mentioned central passage 19 via the pair of coolant receiving pipes 11 and 12. Therefore, it is possible to reduce a degree of impact of the coolant flowed in from the coolant receiving pipes 11 and 12, and it is possible to contribute to causing the flow of the coolant to be smooth.

Next, FIGS. 3-8 show a second preferred embodiment of the coolant passage apparatus in accordance with the present invention. In addition, in the second preferred embodiment shown in FIGS. 3-8, the same reference signs are used for components that achieve the same functions as those shown in FIGS. 1 and 2 as already described, therefore the detailed description will not be repeated. Further, in each of FIGS. 3-8, reference signs are assigned to typical portions, and others are omitted suitably.

Figure 4:
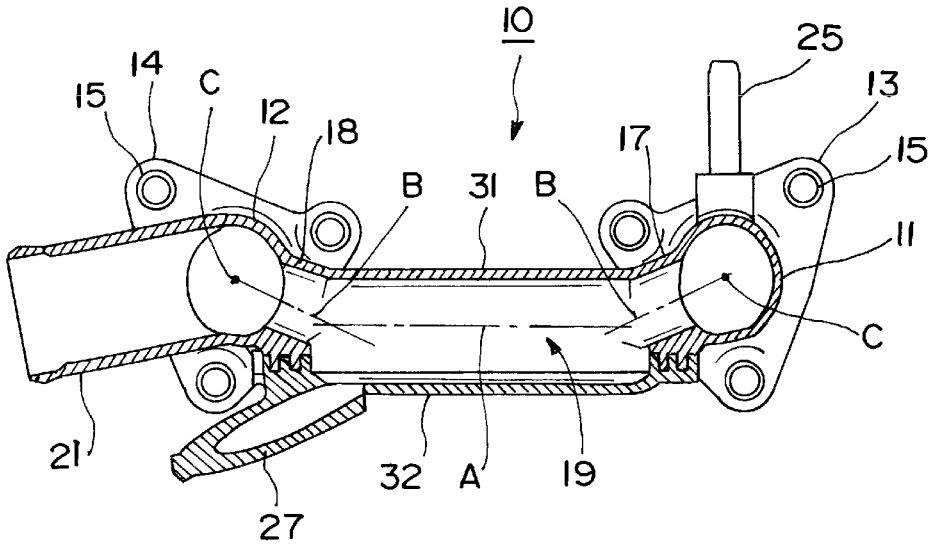
FIG. 4 is sectional view taken along line X-X in FIG. 3 in the direction of arrows.
Figure 7:
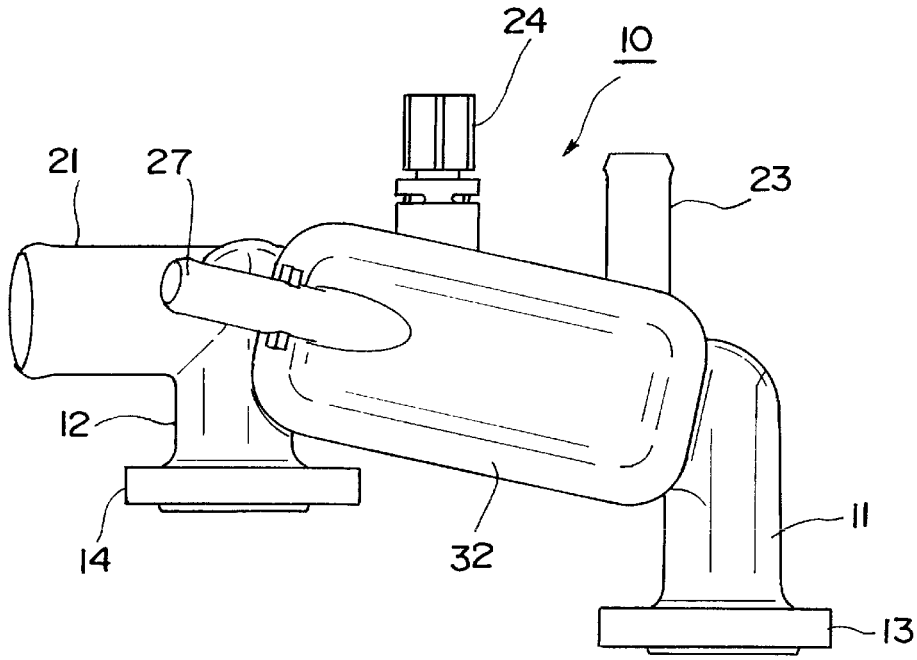
FIG. 7 is a bottom view of the second preferred embodiment.
Figure 8:
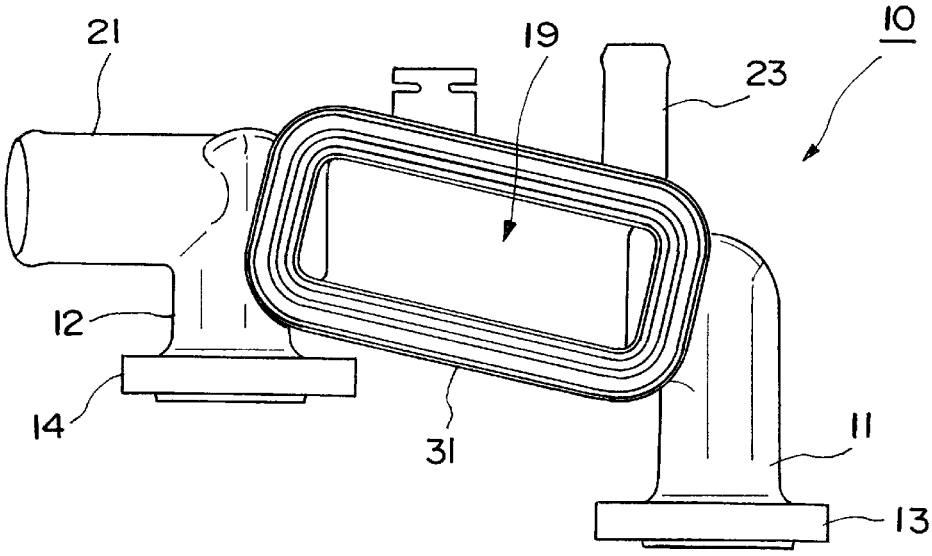
FIG. 8 is a bottom view of the second preferred embodiment in a situation where a second body on the bottom side is removed.

In this second preferred embodiment, the communicating tube 21 which is towards the radiator is formed along an extension in the longitudinal direction of the above-mentioned central passage 19 so as to communicate with one end side in the central passage 19, i.e., a connection between the central passage 19 and the coolant receiving pipe 12 as shown in FIG. 4. Further, in this preferred embodiment, a communicating tube 27 which is towards an EGR cooler is formed in the second body 32 which functions as the cover member as shown in FIG. 7.

Also, in this second preferred embodiment, as shown in FIG. 4 for example, assuming that the line passing through the center of the central passage 19 is (indicated by) A and the lines passing through the centers of the riser pipes 17 and 18 are (indicated by) B respectively, each of the above-mentioned lines B is outwardly and obtusely angled with respect to the above-mentioned line A, and the above-mentioned riser pipes 17 and 18 are respectively molded on both sides of the above-mentioned central passage 19 to incline outwardly.

Figure 5:
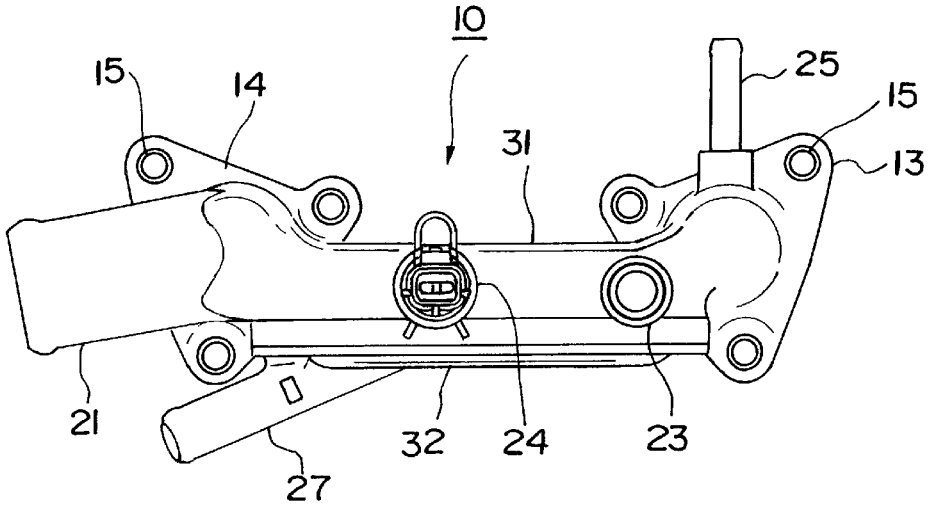
FIG. 5 is a front view showing the second preferred embodiment.
Figure 6:
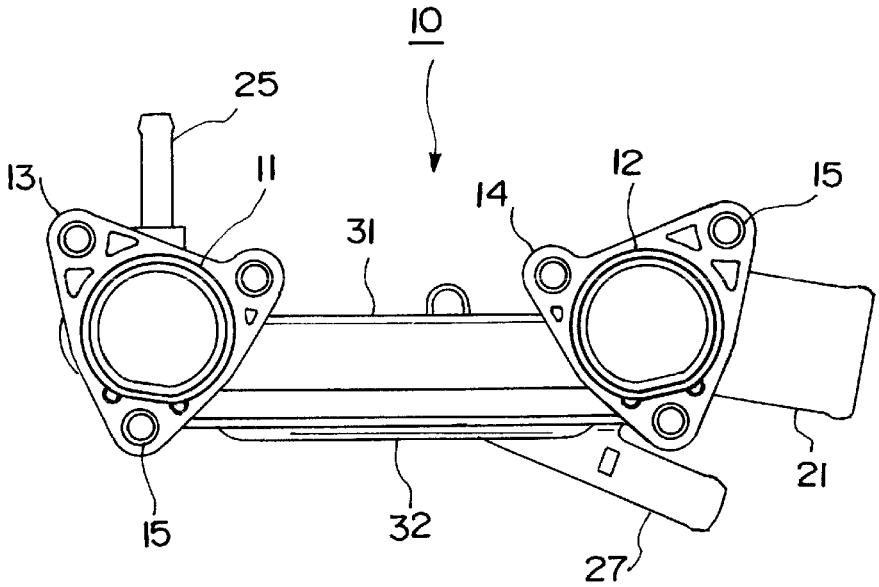
FIG. 6 is a rear view of the second preferred embodiment.

According to this structure, it is possible to obtain operational effects similar to those in the first preferred embodiment as already described, such as the smooth flow of the coolant in the apparatus 10 etc. Further, according to the above-mentioned structure, since a size in the length direction of the central passage 19 is reduced and the central passage 19 does not project excessively in the length direction, the positions of the bolt inserting holes 15 formed in the flanges 13 and 14 are regularly arranged to be of a substantially equilateral triangle where the coolant receiving pipes 11 and 12 are in the center as shown in FIGS. 4-6, for example.

In other words, it is possible to solve the problem that the excessive projection of the central passage 19 in the length direction may cause trouble in bolt fitting operation, such as difficulty in inserting a tool, and that the bolt inserting holes 15 must be formed in irregular positions in order to avoid the trouble.

Further, since the positions of the bolt inserting holes 15 formed in the flanges 13 and 14 can be regularly arranged to be of a substantially equilateral triangle where the coolant receiving pipes 11 and 12 are in the center, bearing pressure applied to sealing surface between the engine head and the flange 13 or 14 can be made uniform, and the sealability between both can be improved.

In addition, in the preferred embodiment as described above, the description is carried out with reference to the case where the coolant passage apparatus 10 is mounted to the V-engine, but the coolant passage apparatus 10 in accordance with the present invention is not limited thereto and can be applied to a horizontal opposed type engine or an in-line engine, for example.

What is claimed is:

1. A coolant passage apparatus used for a cooling device of an internal combustion engine in which a circulation channel for a coolant is formed between a fluid passage formed in the internal combustion engine and a radiator, the coolant passage apparatus capable of being disposed between a coolant outlet of said internal combustion engine and a coolant inlet of said radiator, the coolant passage apparatus comprising:

a pair of coolant receiving pipes for respectively receiving the coolant from a pair of engine heads in said internal combustion engine, riser pipes adjoining said pair of coolant receiving pipes, a central passage formed between said riser pipes, and a communicating tube for outputting coolant towards the radiator, formed so as to communicate with said central passage, wherein said coolant passage apparatus is formed by joining a plurality of resin moldings which are each individually molded, wherein assuming that a longitudinal line passing through the center of said central passage is A and longitudinal lines passing through the centers of said riser pipes are B respectively, when viewed along an axis of said pair of coolant receiving pipes, angles formed by each of said lines B and said line A, and which are closest to a longitudinal center of said central passage, are obtuse, wherein, when viewed along the axis of said pair of coolant receiving pipes, said riser pipes are respectively molded on both sides of said central passage and incline outwardly from the longitudinal center of said central passage, wherein said plurality of resin moldings includes a first body and a second body, and wherein a junction face is formed between said first body and second body so as to be parallel with a surface along said line A.

2. The coolant passage apparatus as claimed in claim 1, wherein said pair of coolant receiving pipes and said communicating tube are integrally molded in one resin molding among said plurality of resin moldings.

3. The coolant passage apparatus as claimed in claim 1, wherein flange-like joints are formed respectively around openings of said pair of coolant receiving pipes, and wherein each of said flange-like joints has bolt inserting holes formed therein.

4. A coolant passage apparatus used for a cooling device of an internal combustion engine in which a circulation channel for a coolant is formed between a fluid passage formed in the internal combustion engine and a radiator, the coolant passage apparatus capable of being disposed between a coolant outlet of said internal combustion engine and a coolant inlet of said radiator, the coolant passage apparatus comprising:

a pair of coolant receiving pipes for respectively receiving the coolant from a pair of engine heads in said internal combustion engine, riser pipes adjoining said pair of coolant receiving pipes, a central passage formed between said riser pipes, and a communicating tube for outputting coolant towards the radiator, formed so as to communicate with said central passage, wherein said coolant passage apparatus is formed by joining a plurality of resin moldings which are each individually molded, wherein assuming that a longitudinal line passing through the center of said central passage is A and longitudinal lines passing through the centers of said riser pipes are B respectively, when viewed along an axis of said pair of coolant receiving pipes, angles formed by each of said lines B and said line A, and which are closest to a longitudinal center of said central passage, are obtuse, wherein, when viewed along the axis of said pair of coolant receiving pipes, said riser pipes are respectively molded on both sides of said central passage and incline outwardly from the longitudinal center of said central passage, wherein said communicating tube is formed in the longitudinal center of said central passage, and is provided between said riser pipes, wherein, when said coolant passage apparatus is viewed in a plan view, an angle formed by a longitudinal line C passing through the center of one of said pair of coolant receiving pipes and said line A, and which is closest to the longitudinal center of the central passage, is obtuse, wherein, when said coolant passage apparatus is viewed in a plan view, an angle formed by a longitudinal line C passing through the center of the other one of said coolant receiving pipes and said line A, and which is closest to the longitudinal center of the central passage, is acute, and wherein the lines C are parallel with each other.

5. The coolant passage apparatus as claimed in claim 4, wherein said pair of coolant receiving pipes and said communicating tube are integrally molded in one resin molding among said plurality of resin moldings.

6. The coolant passage apparatus as claimed in claim 4, wherein flange-like joints are formed respectively around openings of said pair of coolant receiving pipes, and wherein each of said flange-like joints has bolt inserting holes formed therein.

* * * * *